US011433674B2

(12) United States Patent
Horiuchi et al.

(10) Patent No.: US 11,433,674 B2
(45) Date of Patent: Sep. 6, 2022

(54) LIQUID DISCHARGE HEAD AND METHOD FOR PRODUCING LIQUID DISCHARGE HEAD

(71) Applicant: CANON KABUSHIKI KAISHA, Tokyo (JP)

(72) Inventors: Isamu Horiuchi, Kanagawa (JP); Kazunari Ishizuka, Shizuoka (JP); Satoshi Tsutsui, Kanagawa (JP); Yohei Hamade, Tokyo (JP); Miho Ishii, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 1 day.

(21) Appl. No.: 17/149,979

(22) Filed: Jan. 15, 2021

(65) Prior Publication Data

US 2021/0221137 A1 Jul. 22, 2021

(30) Foreign Application Priority Data

Jan. 22, 2020 (JP) ..... JP2020-008035

(51) Int. Cl.
*B41J 2/16* (2006.01)
*B41J 2/14* (2006.01)

(52) U.S. Cl.
CPC ..... *B41J 2/1645* (2013.01); *B41J 2/14233* (2013.01); *B41J 2/161* (2013.01); (Continued)

(58) Field of Classification Search
CPC ..... B41J 2/1645; B41J 2/14233; B41J 2/161; B41J 2/1623; B41J 2/1629; B41J 2/1631; (Continued)

(56) References Cited

U.S. PATENT DOCUMENTS 5,478,606 A 12/1995 Ohkuma et al.
7,687,552 B2 3/2010 Otaka et al.
(Continued)

FOREIGN PATENT DOCUMENTS

JP 6-286149 A 10/1994
JP 2007-186685 A 7/2007
JP 4078295 B2 * 4/2008 ..... B41J 2/14129

OTHER PUBLICATIONS

IP.com search (Year: 2022).*
U.S. Appl. No. 17/153,081, filed Jan. 20, 2021, Ishizuka et al.
U.S. Appl. No. 17/128,445, filed Dec. 21, 2020, Tsutsui et al.

*Primary Examiner* — Lisa Solomon
(74) *Attorney, Agent, or Firm* — Venable LLP

(57) ABSTRACT

A liquid discharge head comprising a substrate comprising a liquid feeding port and an energy generating element for liquid discharge, and a flow channel member comprising, on the substrate, a discharge port through which a liquid is discharged and a liquid flow channel communicating with both the liquid feeding port and the discharge port, wherein the flow channel member comprises a flow channel member (1) not comprising a surface in contact with the liquid and a flow channel member (2) comprising a surface in contact with the liquid, a film stress $S_1$ and $S_2$ of the flow channel members (1) and (2), respectively, satisfy $S_1<S_2$, a film thickness $L_1$ and $L_2$ of the flow channel member (1) and (2), respectively, in a direction perpendicular to the substrate, satisfy $L_1<L_2$, and satisfying 470 MPa·μm<$[L_1 \times S_1+(L_2-L_1)\times S_2]$<1200 MPa·μm.

20 Claims, 7 Drawing Sheets

(52) U.S. Cl.
CPC ..... *B41J 2/1623* (2013.01); *B41J 2/1629* (2013.01); *B41J 2/1631* (2013.01); *B41J 2002/14266* (2013.01)

(58) Field of Classification Search
CPC .... B41J 2002/14266; B41J 2002/14475; B41J 2/1603; B41J 2/1606; B41J 2/1628; B41J 2/1639
See application file for complete search history.

(56) References Cited

U.S. PATENT DOCUMENTS

| | | | |
|---|---|---|---|
| 7,709,554 | B2 | 5/2010 | Otaka et al. |
| 7,887,162 | B2 | 2/2011 | Otaka et al. |
| 7,947,336 | B2 | 5/2011 | Otaka et al. |

* cited by examiner

LIQUID DISCHARGE HEAD AND METHOD FOR PRODUCING LIQUID DISCHARGE HEAD

BACKGROUND OF THE INVENTION

Field of the Invention

The present invention relates to a liquid discharge head and to a method for producing a liquid discharge head.

Description of the Related Art

Liquid discharge heads are used, for instance as inkjet heads, in order to discharge ink in inkjet recording devices. The liquid discharge heads that are utilized in inkjet heads are generally provided with a plurality of fine liquid discharge ports and a flow channel, nozzles that connect the discharge ports and the flow channel, a feeding port that supplies a liquid to the flow channel, and energy generating elements for discharging the liquid.

Japanese Patent Application Publication No. H06-286149 describes the following as a method for producing such a liquid discharge head.

On a substrate having energy generating elements a flow channel pattern is formed using a positive-type photosensitive resin that is soluble in a developing solution, and a negative-type epoxy resin composition that forms nozzles is applied on this flow channel pattern.

After exposure of the epoxy resin composition to the shape of discharge ports, an uncured portion of the epoxy resin composition and the positive-type photosensitive resin are removed separately, to form a flow channel, nozzles, and discharge ports. Ink feeding ports are formed thereafter by etching from the back surface of the substrate.

SUMMARY OF THE INVENTION

One aspect of the present disclosure relates to a liquid discharge head, comprising:

a substrate comprising a liquid feeding port and an energy generating element for liquid discharge; and a flow channel member comprising, on the substrate, a discharge port through which a liquid is discharged, and a liquid flow channel that communicates with both the liquid feeding port and the discharge port, wherein the flow channel member comprises a flow channel member (1) not comprising a surface in contact with the liquid and a flow channel member (2) comprising a surface in contact with the liquid, a film stress $S_1$ of the flow channel member (1) and a film stress $S_2$ of the flow channel member (2) are in a relationship $S_1<S_2$, a film thickness $L_1$ of the flow channel member (1) and a film thickness $L_2$ of the flow channel member (2), in a direction perpendicular to the substrate, are in a relationship $L_1<L_2$, and the film stress $S_1$ and $S_2$ and the film thickness $L_1$ and $L_2$ satisfy a relationship of Expression (I) below:

$$470\ \text{MPa}\cdot\mu\text{m}<[L_1\times S_1+(L_2-L_1)\times S_2]<1200\ \text{MPa}\cdot\mu\text{m} \quad \text{(I)}.$$

Other aspect of the present disclosure relates to a method for producing a liquid discharge head that comprises a substrate comprising a liquid feeding port and an energy generating element for liquid discharge, and a flow channel member comprising, on the substrate, a discharge port through which a liquid is discharged and a liquid flow channel that communicates with both the liquid feeding port and the discharge port, with the flow channel member comprising a flow channel member (1) not comprising a surface in contact with the liquid and a flow channel member (2) comprising a surface in contact with the liquid, the method comprising:

forming, on the substrate, a flow channel member (1) that constitutes a part of a side wall of the liquid flow channel, by patterning of a photosensitive resin composition; and patterning a photosensitive resin composition so as to cover the flow channel member (1), to form a flow channel member (2) that comprises the discharge port through which a liquid is discharged, and the liquid flow channel that communicates with both the liquid feeding port and the discharge port, wherein a film stress $S_1$ of the flow channel member (1) and a film stress $S_2$ of the flow channel member (2) are in a relationship $S_1<S_2$, a film thickness $L_1$ of the flow channel member (1) and a film thickness $L_2$ of the flow channel member (2), in a direction perpendicular to the substrate, are in a relationship $L_1<L_2$, and the film stress $S_1$ and $S_2$ and the film thickness $L_1$ and $L_2$ satisfy a relationship of Expression (I) below:

$$470\ \text{MPa}\cdot\mu\text{m}<[L_1\times S_1+(L_2-L_1)\times S_2]<1200\ \text{MPa}\cdot\mu\text{m} \quad \text{(I)}.$$

Further features of the present invention will become apparent from the following description of exemplary embodiments with reference to the attached drawings.

DESCRIPTION OF THE EMBODIMENTS

Figure 1A:
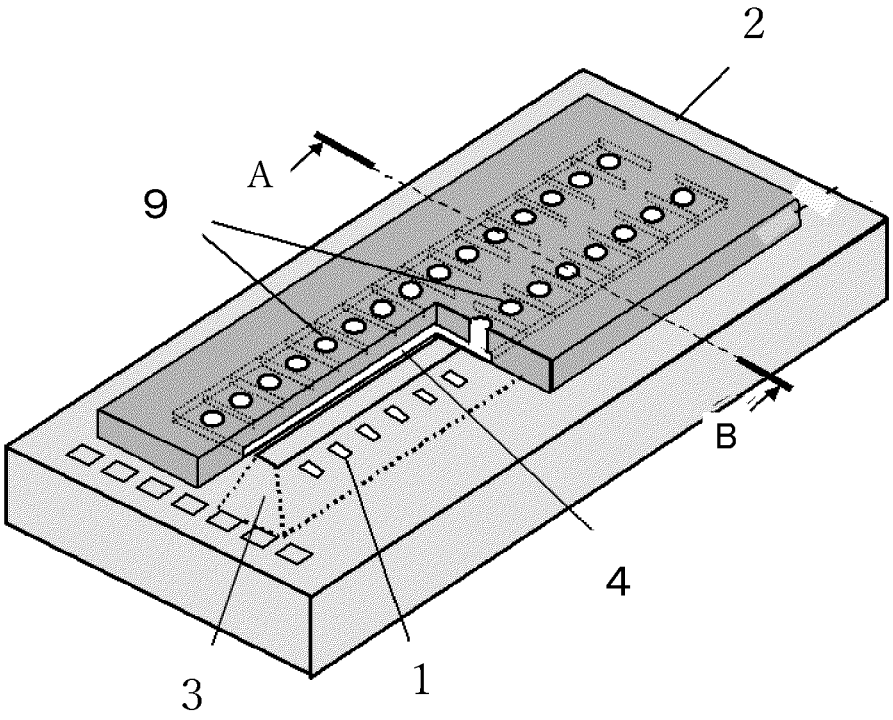
FIG. 1A is a schematic perspective-view diagram illustrating an example of the configuration of a liquid discharge head.

Further miniaturization and higher densities achieved in recent years in discharge ports and flow channels in inkjet recording technologies have significantly contributed to realizing printing with higher definition and at higher speeds. However, the liquid components of inks permeate into an epoxy resin composition that makes up the discharge ports and the flow channels; in consequence, miniaturization and higher densities entail a correspondingly greater impact of volume expansion arising from such permeation. The impact on printing stability and on adhesiveness of the resin composition becomes substantial as a result. Another concern is that volume expansion of the epoxy resin composition may further increase when the ratio of the organic solvent in an ink composition rises.

An effect of suppressing volume expansion can be generally expected to be achieved by using an epoxy resin having a benzene skeleton and a large oxygen equivalent, as the main material of an ink composition. Further, by three-dimensional bonding of the epoxy resins above, a cured product having excellent mechanical strength can be formed.

In Japanese Patent Application Publication No. 2007-186685 an epoxy resin having a dicyclopentadiene skeleton and exhibiting low liquid permeability is added to a negative-type epoxy resin composition, for the purpose of suppressing volume expansion of the epoxy resin composition.

However, film stress tends to increase as a result of an improvement in the permeation resistance and the mechanical strength of the cured product of an at least tri-functional epoxy resin having a rigid structure, such as a benzene skeleton or a dicyclopentadiene skeleton.

It has further been found that an increase in film stress translates into greater deformation of the substrate on which a film of the epoxy resin composition is formed, which in turn may result in peeling of the epoxy resin composition off the substrate, or in damage to the substrate.

The present disclosure provides a liquid discharge head, and a method for producing a liquid discharge head, in which deformation of a substrate and of a flow channel member is suppressed, and peeling of the flow channel member off the substrate is likewise suppressed.

Embodiments for carrying out the present disclosure will be illustrated specifically below with reference to accompanying drawings. The dimensions, materials, shapes, relative arrangement positions and so forth of constituent parts described in the embodiments are to be modified as appropriate depending on the configuration of the members to which the invention is to be applied, and depending on various conditions. That is, the scope of the present disclosure is not meant to be limited to the embodiments below.

In the present disclosure, the notations "from XX to YY" and "XX to YY" representing a numerical range denote, unless otherwise stated, a numerical value range that includes the lower limit and the upper limit thereof, as endpoints.

In a case where numerical value ranges are described in stages, the upper limits and the lower limits of the respective numerical value ranges can be combined arbitrarily.

In the explanation below, features having identical functions are denoted in the drawings with identical reference symbols, and a recurrent explanation thereof may be omitted.

Reference symbols in the drawings are as follows. 1: energy generating element; 2: substrate; 3: liquid feeding port; 4: liquid flow channel; 5: flow channel member (1); 6: nozzle; 7: flow channel member (2); 8: water-repellent layer; 9: discharge port; 10: resin composition; 11: flow channel formation mask (1); 12: flow channel pattern; 13: epoxy resin composition (1); 14: nozzle formation mask; 15: protrusion; 16: epoxy resin composition (2); 17: flow channel formation mask (2); and 18: flow channel forming member (2-1)

An inkjet head will be exemplarily illustrated herein as an example of use of the liquid discharge head, but the scope of use of the liquid discharge head is not limited thereto.

Figure 1B:
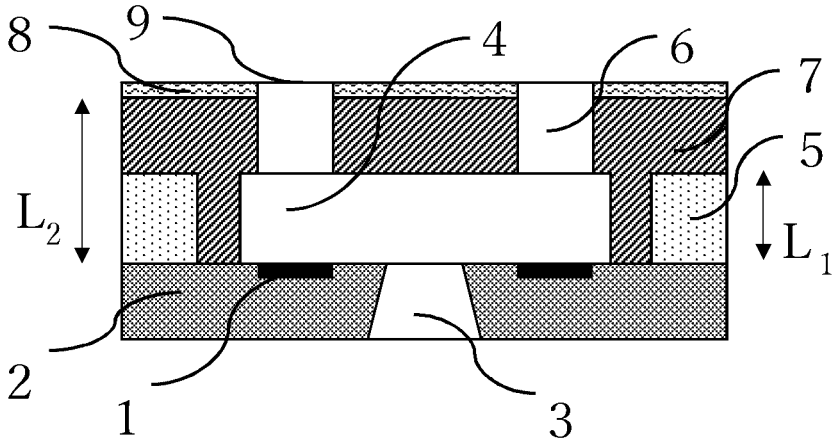
FIG. 1B is a schematic cross-sectional diagram along line A-B of FIG. 1A.

FIG. 1A is a schematic perspective-view diagram illustrating an example of the configuration of a liquid discharge head (inkjet head) according to an embodiment of the present disclosure. FIG. 1B is an example of a schematic cross-sectional diagram of a liquid discharge head (inkjet head), as viewed from a plane perpendicular to a substrate, and which passes through line A-B in FIG. 1A.

The inkjet head comprises a substrate 2 in which energy generating elements 1 (energy generating elements for liquid discharge) that generate energy for discharging a liquid (for instance an ink) are formed at a predetermined pitch. A liquid feeding port 3 through which ink is supplied is opened in the substrate 2.

On the substrate 2, a flow channel member (1) 5 that constitutes at least a part of the side wall of a liquid flow channel 4 covers a flow channel member (2) 7 that constitutes the liquid flow channel 4 comprising nozzles 6 so as not to come into contact with the liquid. A flow channel member is formed as a result.

That is, the flow channel member comprises a flow channel member (1) 5 not comprising a surface in contact with the liquid, and a flow channel member (2) 7 comprising a surface in contact with the liquid.

A water-repellent layer 8 is further laid as needed, and there are formed discharge ports 9 as orifices of the flow channel member from which ink droplets are discharged. The liquid flow channel 4 communicates with the liquid feeding port 3 and the discharge ports 9.

Further, $L_1$ denotes herein the film thickness of the flow channel member (1) 5, and $L_2$ denotes the thickness of the flow channel member (2) 7, in a direction perpendicular to the substrate 2.

The flow channel member (2) 7 comprising a surface in contact with the ink is preferably a cured product of a photosensitive resin composition having photolithography performance. Preferably, the cured product of the photosensitive resin composition exhibits herein superior mechanical strength and superior permeation resistance against liquids.

In order to satisfy the above characteristics, the photosensitive resin composition preferably comprises an epoxy resin of cationic polymerization type. The epoxy resin is preferably herein a thermosetting resin having a reactive epoxy group at terminals.

Preferably, the photosensitive resin composition comprises a cationic polymerization-type multifunctional epoxy resin having an at least tri-functional functional epoxy group. Preferably the epoxy resin is an epoxy resin having, in the molecule, one skeleton selected from the group consisting of a benzene skeleton, a dicyclopentadiene skeleton, a naphthalene skeleton and a biphenyl skeleton. The cured product of the photosensitive resin composition comprising the multifunctional epoxy resin has particularly superior properties in terms of mechanical strength and permeation resistance.

On the other hand, the rigid structure of such cured products tends to result in comparatively larger film stress than in the case of cured products of photosensitive resin compositions that comprise a cationic polymerization-type epoxy resin having a bifunctional epoxy group, or an epoxy resin not having a benzene skeleton. In the present disclosure the wording "having an at least X-functional epoxy group" signifies "having at least X epoxy groups in one molecule".

In the present disclosure a film stress $S_1$ of the flow channel member (1) and a film stress $S_2$ of the flow channel member (2) obey $S_1<S_2$. A known material can therefore be used as the material that makes up the flow channel member (1), without particular limitations, so long as the material satisfies the above relationship film stress $S_1$<film stress $S_2$.

Specific examples include for instance cured products of known positive-type photosensitive resin compositions having photolithography performance, or of compositions of epoxy resins of cationic polymerization type, in order to form the flow channel member (1).

By lowering herein the film stress of the flow channel member (1) below that of the flow channel member (2) it becomes possible to suppress deformation of the substrate due to stress, and to suppress peeling of the flow channel member (2) off the substrate, to a greater degree than in a case where the side wall of the flow channel is formed by the flow channel member (2) alone.

Film stress can be measured using a thin-film stress measuring device (for example, FLX-2320) by Toho Technology Corp. A film to be measured is formed on a silicon substrate, to an arbitrary thickness, and is subjected to desired processing, after which warping of the silicon substrate is measured using a thin-film stress measuring device; film stress can be then calculated thereby on the basis of Expression (1) below.

$$S=Eh^2/(1-v)6Rt \quad (1)$$

(where E/(1−v): biaxial elastic modulus (Pa) of the silicon substrate; h: thickness (m) of the silicon substrate; t: thickness (m) of the film to be measured; R: curvature radius (m) of the substrate; S: average value (Pa) of film stress; $1/R=1/R_2-1/R_1$; $R_1$: curvature radius prior to film formation; and $R_2$: curvature radius after a desired process subsequent to film formation).

Preferably, the film stress $S_2$ of the cured product of the photosensitive resin composition that makes up the flow channel member (2) is at least 20 MPa, at least 22 MPa, or at least 25 MPa. The upper limit of the film stress $S_2$ is not particularly restricted, but is preferably not more than 35 MPa, or not more than 33 MPa, or not more than 30 MPa.

The film stress $S_1$ of the flow channel member (1) is preferably not more than 20 MPa, or not more than 18 MPa, or not more than 17 MPa, in order to suppress peeling of the flow channel member (2) due to film stress. The lower limit of the film stress $S_1$ is not particularly restricted, but is preferably at least 8 MPa, or at least 9 MPa, or at least 10 MPa.

The following findings were arrived at in the present disclosure after repeated assessments while factoring in also the film thickness $L_1$ of the flow channel member (1) and the film thickness $L_2$ of the flow channel member (2) in a direction perpendicular to the substrate, from the viewpoint of suppressing peeling of the flow channel member off the substrate, and suppressing deformation the flow channel member.

Specifically, the film stress $S_1$ and $S_z$, and the film thickness $L_1$ and $L_2$, satisfy Expression (I) below.

$$470\ \text{MPa}\cdot\mu\text{m}<[L_1\times S_1+(L_2-L_1)\times S_2]<1200\ \text{MPa}\cdot\mu\text{m} \quad (\text{I})$$

Preferably, the film stress $S_1$ and $S_2$, and the film thickness $L_1$ and $L_2$, further satisfy Expression (I') below.

$$650\ \text{MPa}\cdot\mu\text{m}<[L_1\times S_1+(L_2-L_1)\times S_2]<900\ \text{MPa}\cdot\mu\text{m} \quad (\text{I}')$$

By satisfying the above relationship film stress $S_1$<film stress $S_2$, and also the relationship of Expression (I), it becomes possible to suppress deformation of the substrate and of the flow channel member, and to suppress peeling of flow channel member off the substrate.

Preferably, the flow channel member (1) comprises a positive-type photosensitive resin composition. The positive-type photosensitive resin composition is preferably a photodegradable positive-type photosensitive resin composition in which a main chain is cleaved by irradiation with light.

The photodegradable positive-type photosensitive resin composition is water-insoluble; although the resin composition is soluble in organic solvents even after photodecomposition, the solubility of the resin composition in water remains however extremely low. Combined with permeation resistance, the photodegradable positive-type photosensitive resin composition has thermoplastic character, and exhibits low film stress; the resin composition is therefore suitable as a material for forming the flow channel member (1), in a case where a water-soluble ink is used.

Moreover, cutting of the main chain results in a lower molecular weight, which further allows reducing film stress. The flow channel member can be designed so as to satisfy the above relationship film stress $S_1$<film stress $S_2$, or the relationship in Expression (I), by using the foregoing materials as the materials that to form the flow channel member (1).

Examples of these photodegradable positive-type photosensitive resin compositions include polymethacrylic acid ester-based positive-type resists, polyacrylic acid ester-based positive-type resists and polymethylisopropenyl ketones. Specifically, the photodegradable positive-type photosensitive resin composition preferably comprises for instance polymethyl methacrylate and a copolymer of methyl methacrylate and a vinyl monomer having a ketone moiety; a mixture of polymethyl methacrylate and polystyrene, polyvinyl acetate or polycarbonate; a copolymer of methyl methacrylate and an acrylic acid ester; polymethylisopropenyl ketone; or polyphenylvinyl ketone.

As the polymethylisopropenyl ketone there can be suitably used "ODUR-1010" (product name), by Tokyo Ohka Kogyo Co., Ltd.

A composition similar to the photosensitive resin composition for forming the flow channel member (2) may be used as the photosensitive resin composition for forming the flow channel member (1). In that case the resin composition may be selected as appropriate so as to satisfy the above relationship film stress $S_1$<film stress $S_2$.

Preferably, the above relationship film stress $S_1$<film stress $S_2$ is satisfied in the case of using a cured product of a composition of an epoxy resin of cationic polymerization type. To this end there can be illustratively used a composition resulting from containing mainly a polymer having an alicyclic epoxy structure represented by Formula (a) below, and having no benzene skeleton, as an epoxy resin composition. The above epoxy resin composition has a low oxygen equivalent, and accordingly a cured product thereof is slightly inferior in permeation resistance; however, the epoxy resin composition does exhibit flexibility and hygroscopicity, which translates into low film stress in the cured product, and thus the resin composition is suitable as the flow channel member (1).

Examples of commercially available polymers having an alicyclic epoxy resin include "EHPE-3150" (product name) by Daicel Corporation.

(a)

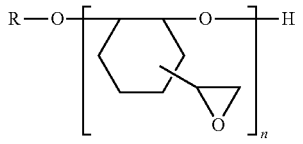

(In Formula (a), R represents a hydrogen atom or an alkyl group having 1 to 3 carbon atoms, and n represents a natural number.)

A preferred embodiment of the composition of an epoxy resin of cationic polymerization type, for forming the flow channel member (1), involves using an epoxy resin composition in which a not more than bi-functional epoxy resin, or a linear resin, is blended with an at least tri-functional epoxy resin as a main material. As a result it becomes possible to reduce film stress in the cured product of the epoxy resin composition.

When a not more than bi-functional epoxy resin is formulated, film stress can be prevented from rising, since in that case the crosslinking density with the at least tri-functional epoxy resin that constitutes the main material is limited. Linear resins have moreover excellent flexibility and, when included in the formulation, are accordingly suitable for suppressing film stress in the cured product.

A bisphenol-type epoxy resin, a phenoxy resin, polyethylene glycol or the like can be used in the resin composition that is formulated in order to reduce film stress.

Examples of commercially available resin compositions include "jER1004", "jER1007", "jER1010" and "jER1256" (product names) by Mitsubishi Chemical Corporation, and "Polyethylene glycol 600", "Polyethylene glycol 1000" and "Polyethylene glycol 2000" (product names) by Toho Chemical Industry Co. Ltd.

A concrete production method will be explained next, but the present invention is not limited thereto.

FIG. 2A to FIG. 2G are schematic cross-sectional diagrams illustrating an example of a method for producing a liquid discharge head (specifically an inkjet head). FIG. 2A to FIG. 2G illustrate a cross-sectional structure in a completed state, as viewed on a plane perpendicular to the substrate, similarly to FIG. 1B.

Figure 2A:
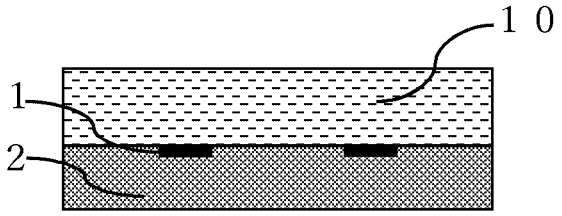
FIG. 2A to FIG. 2G are schematic cross-sectional diagrams illustrating an example of a production process of a liquid discharge head.

Firstly, a film of a positive-type photosensitive resin composition is formed, as a resin composition 10, on a substrate 2 comprising disposed thereon energy generating elements 1 that generate energy for discharging ink (FIG. 2A).

Figure 2B:
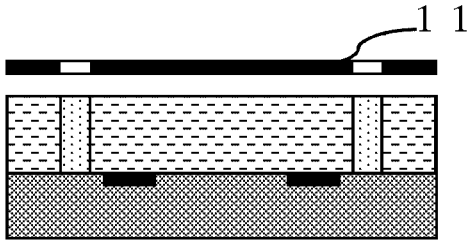

Next, the positive-type photosensitive resin composition is exposed using a flow channel formation mask (1) 11 (FIG. 2B).

Figure 2C:
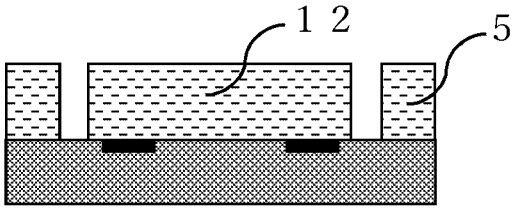

The exposed portion is then dissolved away using an organic solvent, to thereby form the flow channel member (1) 5 and a flow channel pattern 12 (FIG. 2C).

Figure 2D:
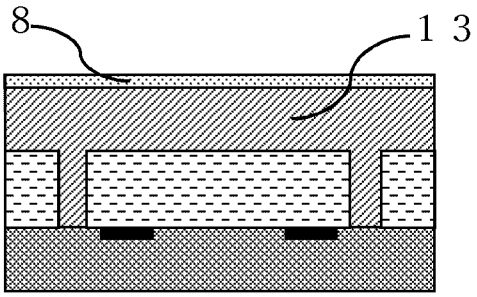

Next, a film of an epoxy resin composition (1) 13 that constitutes the flow channel member (2) 7 is formed, through curing, on the resin composition 10, and a water-repellent layer 8 is formed as needed on the epoxy resin composition (1) 13 (FIG. 2D). Examples of the film formation method include herein a method in which a resin composition that comprises a solvent is applied by spin coating or slit coating, followed by a baking step, to thereby volatilize the solvent, or a lamination method in which an already-formed film is transferred onto a film base material made up of polyethylene terephthalate (PET), a polyimide or the like. These film forming methods can be selectively resorted to as appropriate depending on the type of the resin material and of the solvent.

The water-repellent layer 8 is required to exhibit water repellency towards inks; a perfluoroalkyl composition or perfluoropolyether composition is preferably used herein as the water-repellent layer 8. It is known that the alkyl fluoride chains of perfluoroalkyl compositions and perfluoropolyether compositions generally segregate at the interface between the resin composition and air through baking after application of the resin composition; the water repellency of the surface of the composition can be accordingly increased as a result.

Characteristics that cured products of the epoxy resin composition (1) and a below-described epoxy resin composition (2) are required to exhibit include mechanical strength, permeation resistance against liquids, and adhesiveness to substrates.

In order to ensure the mechanical strength and permeation resistance of the epoxy resin compositions, the film thickness $L_1$ of the flow channel member (1) and the film thickness $L_2$ of the flow channel member (2) in a direction perpendicular to the substrate obey $L_1<L_2$. Preferably, the film thickness $L_1$ and the film thickness $L_2$ satisfy a relationship $L_2-L_1>4$ μm. Herein $L_2-L_1$ is preferably at least 5 μm, at least 10 μm, or at least 15 μm; the upper limit is not particularly restricted, but is preferably not more than 40 μm, or not more than 35 μm. The shape of the discharge ports deforms readily in a case where $L_2-L_1$ is not more than 4 μm.

Preferably, the film thickness $L_1$ is at least 10 μm, or at least 15 μm, or at least 20 μm, and is not more than 40 μm, or not more than 30 μm.

Meanwhile, the film thickness $L_2$ is preferably at least 20 μm, or at least 30 μm, or at least 40 μm, and is not more than 80 μm, or not more than 70 μm.

The resolution as a photolithography material must also be taken into consideration, in order to form fine discharge ports with good precision. As one implementation for satisfying these characteristics, the flow channel member (2) may be made up of a cured product of a negative-type photosensitive resin composition that comprises a cationic polymerization-type multifunctional epoxy resin having an at least tri-functional epoxy group, and a photopolymerization initiator.

Preferably, the cationic polymerization-type multifunctional epoxy resin comprises at least one multifunctional epoxy resin selected from the group consisting of phenol novolac-type, cresol novolac-type and bisphenol A-type novolac epoxy resins.

Further, the at least one cationic polymerization-type multifunctional epoxy resin selected from the group consisting of phenol novolac-type, cresol novolac-type and bisphenol A-type novolac-type epoxy resins has at least one skeleton selected from the group consisting of a dicyclopentadiene skeleton, a biphenyl skeleton and a naphthalene skeleton. By making up thus a photosensitive resin composition together with a photopolymerization initiator, these epoxy resins can be used as a negative-type photocationic polymerization epoxy resin composition having a multifunctional epoxy resin as a main material. Cured products of these negative-type photocationic polymerization epoxy resin compositions can be crosslinked three-dimensionally, and are thus suitable for obtaining desired properties.

Examples of commercially available epoxy resins include "jER157S70" and "jER154" (product names) by Mitsubishi Chemical Corporation; "EPICLON N-695", "EPICLON N-865" and "EPICLON HP-7200" (product names) by DIC Corporation; and "NC-2000", "NC-3000", "NC-7000" and "NC-7300" (product names) by Nippon Kayaku Co., Ltd.

A sulfonic acid compound, a diazomethane compound, a sulfonium salt compound, an iodonium salt compound, a disulfone-based compound or the like is preferred as the photopolymerization initiator. Examples of commercial products include "ADEKA ARKLS SP-170", "ADEKA ARKLS SP-172" and "ADEKA ARKLS SP-150" (product names) by ADEKA Corporation; "BBI-103" and "BBI-102" (product names) by Midori Kagaku Co., Ltd.; "IBPF", "IBCF", "TS-01" and "TS-91" (product names) by Sanwa Chemical Co., Ltd.; "CPI-210", "CPI-300" and "CPI-410" (product names) by San-Apro Ltd.; and "Irgacure 290" and "GSID-26-1" (product names) by BASF Japan Ltd.

Additives can further be added to the above epoxy resin composition, for the purpose of improving photolithography performance, adhesive performance and so forth. Examples include for instance silane coupling agents, photosensitizers such as anthracene derivatives, basic substances such as amines, and acid generators for generating weakly acidic (pKa=from −1.5 to 3.0) toluenesulfonic acid. Examples of commercially available acid generators that generate toluenesulfonic acid include "TPS-1000" (product name) by Midori Kagaku Co., Ltd., and "WPAG-367" (product name) by Wako Pure Chemical Industries, Ltd.

Figure 2E:
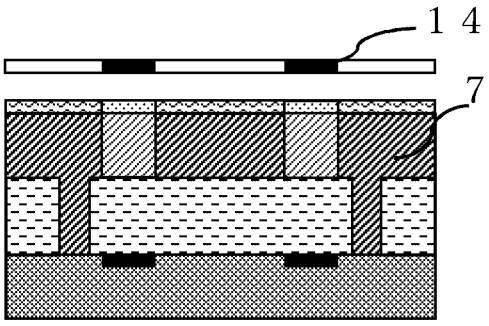

Next, the epoxy resin composition (1) 13 is subjected to pattern exposure (patterning) via a nozzle formation mask 14, which is a photomask (FIG. 2E). The photomask results from forming a light-shielding film such as a chromium film, in accordance with the pattern of the discharge ports and so forth, on a substrate made up of a material such as glass or quartz that transmits light of the exposure wavelength. As the exposure device there can be used a projection exposure device having a single-wavelength light source, such as an i-line exposure stepper or KrF stepper, or having a mercury lamp as a light source, such as a mask aligner MPA-600 Super (product name, by Canon Inc.). A filter that lets through a specific wavelength may be used in combination with these broad-wavelength exposure devices.

Figure 3A:
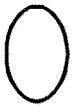
FIG. 3A to FIG. 3C are plan-view diagrams for explaining the shape of a discharge port.
Figure 3B:
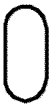
Figure 3C:
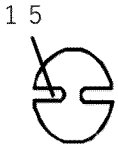

The discharge port pattern, i.e. the planar shapes of the nozzles 6 and discharge ports 9 need not necessarily be circular, and can be appropriately established, including the shapes illustrated in FIG. 3A to FIG. 3C, taking into consideration for instance discharge characteristics. FIG. 3A illustrates an elliptical discharge port, and FIG. 3B illustrates a discharge port made up of an elongated opening having semicircular ends. In particular, FIG. 3C illustrates a shape in which a pair of protrusions 15 pointing towards the center is provided in the circular discharge port.

By using discharge ports having a shape such as that illustrated in FIG. 3C it becomes possible to hold a liquid between the protrusion 15, and to significantly reduce as a result division of a given droplet into a multiple droplets (main droplet and satellites) at the time of droplet ejection. In a case where the liquid discharge head is an inkjet head, therefore, high-quality printing can be achieved by using discharge ports having a planar shape such as that illustrated in FIG. 3C.

Figure 2F:
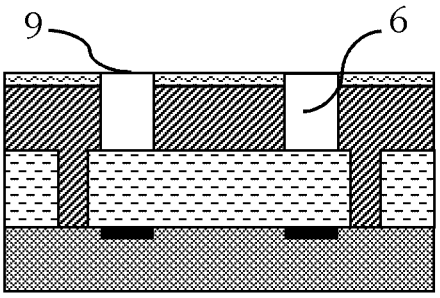

Next, the exposed portion is cured in a baking (heating) treatment (post-exposure bake). The uncured portion of the epoxy resin composition (1) 13 is removed using an organic solvent, to form the nozzles 6 and the discharge ports 9 (FIG. 2F).

Figure 2G:
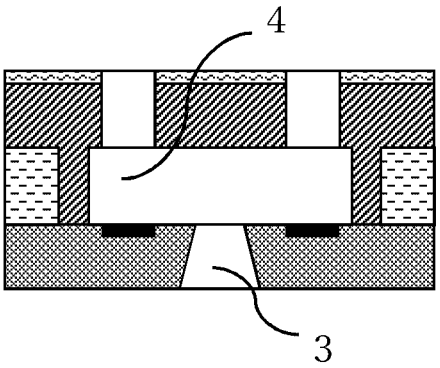

The feeding port 3 is formed next by wet etching, using an alkaline etching solution, or by dry etching. After formation of the discharge ports and so forth, the flow channel pattern 12 is irradiated with deep ultraviolet rays (deep UV), to thereby reduce the molecular weight of the positive-type photosensitive resin composition; the liquid flow channel 4 is then formed through dissolution removal from the feeding port 3 or from the discharge ports 9 (FIG. 2G). Film stress can be further reduced at this time through irradiation of the flow channel member (1) 5, made up of the positive-type photosensitive resin composition, with deep UV. The flow channel member (1) 5 can be irradiated with light in the lapse of time from formation of the nozzles 6 until formation of the feeding port 3.

The inkjet head is then completed, with significantly enhanced mechanical strength, permeation resistance and adhesiveness to the substrate, through baking (heating) of the flow channel member (2) which is a cured product of an epoxy resin composition. In a case where there is a water-repellent layer, water-repellent performance can be improved by causing alkyl fluoride chains to segregate at the interface with air through a thermal treatment.

The purpose of the baking (heating) treatment is to increase crosslinking density through additional reaction of unreacted epoxy resin, and to increase the density of the resin through thermal shrinkage.

To that end there is preferably carried out a treatment at from 150° C. to 250° C., more preferably a treatment at from 170° C. to 250° C., and yet more preferably at from 200° C. to 250° C. At a temperature lower than 150° C., the softening point of the cured product may fail to be reached, resin density may be hard to increase, and adhesiveness to the substrate and permeation resistance may drop. In the case of a temperature higher than 250° C., the cured product of the epoxy resin composition may undergo thermal decomposition.

Another method for producing an inkjet head of the present disclosure will be explained next.

FIG. 4A to FIG. 4I are schematic cross-sectional diagrams illustrating an example of a method for producing a liquid discharge head (specifically an inkjet head). FIG. 4A to FIG. 4I illustrate a cross-sectional structure in a completed state, as viewed on a plane perpendicular to the substrate, similarly to FIG. 1B.

Figure 4A:
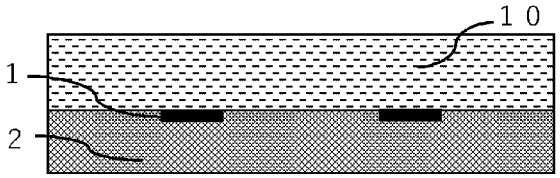
FIG. 4A to FIG. 4I are schematic cross-sectional diagrams illustrating an example of a production process of a liquid discharge head.

Firstly a film of a composition of an epoxy resin of cationic polymerization type is formed, as a resin composition 10, on a substrate 2 having disposed thereon energy generating elements 1 that generate energy for discharging ink (FIG. 4A).

Figure 4B:
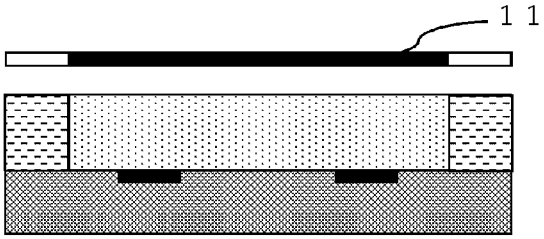
Figure 4C:
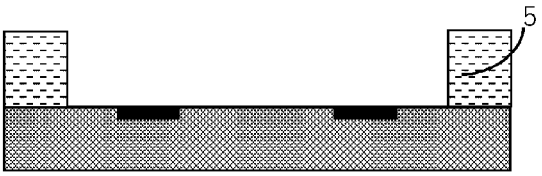

Next, the epoxy resin composition is subjected to pattern exposure (patterning) using the flow channel formation mask (1) 11 (FIG. 4B). The unexposed portion is then dissolved away using an organic solvent, to thereby form the flow channel member (1) 5 (FIG. 4C).

Figure 4D:
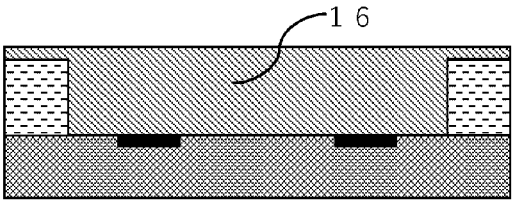

Next, a film of an epoxy resin composition (2) 16 that constitutes a flow channel forming member (2-1) 18 is formed, through curing, on the flow channel member (1) 5 (FIG. 4D).

Figure 4E:
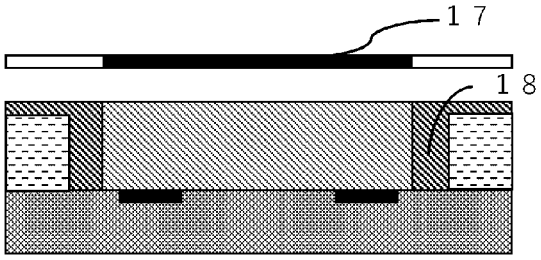

The epoxy resin composition (2) 16 is subjected to pattern exposure via a flow channel formation mask (2) 17, to form the flow channel forming member (2-1) 18 (FIG. 4E).

Figure 4F:
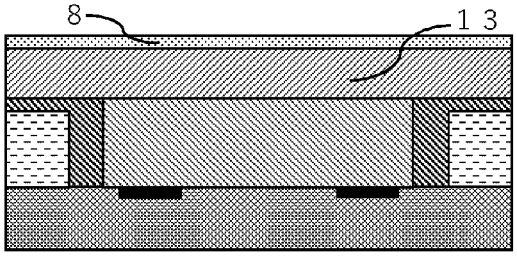

On the epoxy resin composition (2) 16 there is formed next, by curing, a film of the epoxy resin composition (1) 13 that constitutes a flow channel member (2-2) 7, and a water-repellent layer 8 is formed on the epoxy resin composition (1) 13, as needed (FIG. 4F).

Figure 4G:
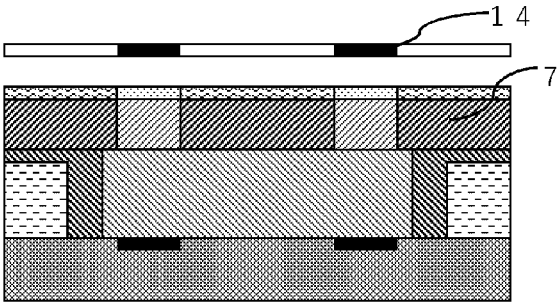

Further, the epoxy resin composition (1) 13 is pattern-exposed via the nozzle formation mask 14 (FIG. 4G).

The epoxy resin composition (2) is imparted herein with a sensitivity difference (difference in exposure dose necessary for curing) or a photosensitive wavelength difference (difference in the exposure wavelength necessary for curing) with respect to that of the epoxy resin composition (1). As a result this precludes curing of the epoxy resin composition (2) at the time of patterning of the epoxy resin composition (1).

Figure 4H:
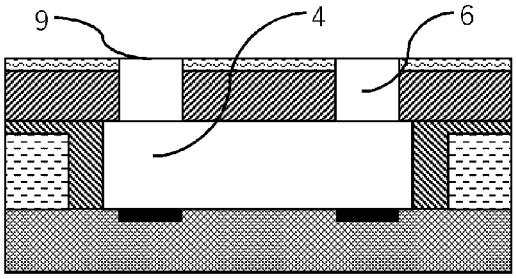

Next, the exposed portion is cured in a baking (heating) treatment (post-exposure bake). Thereafter the uncured portions of the epoxy resin composition (1) 13 and of the epoxy resin composition (2) 16 are removed using an organic solvent, to thereby form the liquid flow channel 4, the nozzles 6 and the discharge ports 9 (FIG. 4H).

Figure 4I:
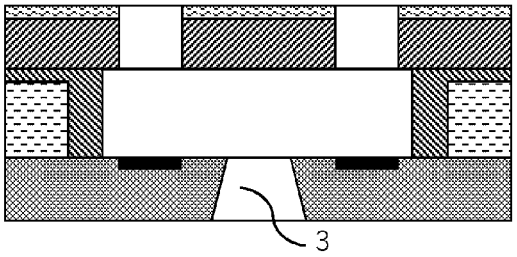

Next, the feeding port 3 is formed and the inkjet head is then completed by thermally treating the flow channel member (2-2) 7 and the flow channel forming member (2-1) 18 which are cured products of the epoxy resin compositions (FIG. 4I).

The present example is a flow channel member such that the flow channel member (2) comprises: the flow channel forming member (2-1) 18 provided on a substrate and that forms a side wall of a liquid flow channel; and the flow channel member (2-2) 7 provided on the flow channel forming member (2-1) 18 and that comprises discharge ports through which a liquid is discharged. Further, the flow channel forming member (2-1) 18 and the flow channel member (2-2) 7 are formed of cured products of different negative-type photosensitive resin compositions.

The step of forming the flow channel member (2) includes a step of forming the flow channel forming member (2-1) that forms the side wall of a liquid flow channel, through patterning of the negative-type photosensitive resin composition 1 so as to cover the flow channel member (1). The step of forming the flow channel member (2) further includes a step of forming the flow channel member (2-2) by laying a negative-type photosensitive resin composition 2 on the flow channel forming member (2-1), and patterning the negative-type photosensitive resin composition 2 so as to form discharge ports through which a liquid is discharged.

EXAMPLES

The present disclosure will be explained in detail below with reference to examples and comparative examples, but the disclosure is not limited to the features that are implemented in these examples. The notation "parts" in the examples and comparative examples denotes "parts by mass" unless otherwise specified.

Herein there were formulated the epoxy resin compositions for forming a flow channel member given in Table 1, the epoxy resin compositions for forming a flow channel member given in Table 2, and the epoxy resin composition for forming a flow channel member given in Table 3.

The epoxy resins in the tables are "jER157S70", "jER1004" and "JER1007" (all product names) by Mitsubishi Chemical Corporation; "EPICLON N-695" and "EPICLON HP-7200" (both product names) by DIC Corporation; "EHPE-3150" (product name) by Daicel Corporation; and "NC-3000" and "NC-7000" (both product names) by Nippon Kayaku Co., Ltd.

The additive is "Polyethylene glycol 1000" and "Polyethylene glycol 2000" (product names) by Toho Chemical Industry Co. Ltd.

The photopolymerization initiator is "ADEKA Optomer SP-172" (product name) by ADEKA Corporation and "CPI-410" (product name) by San-Apro Ltd.

The sensitivity adjusting agent is "TPS-1000" (product name) by Midori Kagaku Co., Ltd.

The silane coupling agent is "A-187" (product name) by Momentive Performance Materials Inc.

The compositions in the tables denote parts by mass.

Herein "ADEKA Optomer SP-172" is a propylene carbonate solution having solids of 50%; the compositions in the tables represent parts by mass of the solution.

To dissolve the resins, 2-methoxy-1-methylethyl acetate (PGMEA) or xylene were used as a solvent that was added in an amount adjusted in accordance with film thickness. The film stress of the cured products of the formulated epoxy resin compositions was measured.

First, each resin composition was applied onto a silicon substrate and was thermally treated at 90° C., to form a film. Next, the film was exposed at an arbitrary exposure dose, and was thermally treated (post-exposure bake) at 90° C., followed by a thermal treatment at 200° C. to produce a cured product, the film stress of which was measured using a thin-film stress measuring device (FLX-2320) by Toho Technology Corp.

TABLE 1

| | | Epoxy resin composition | | | |
|---|---|---|---|---|---|
| | | <A-1> | <A-2> | <A-3> | <A-4> |
| Epoxy resin | jER157S70 | — | — | 100 | — |
| | EPICLON N-695 | — | — | — | 90 |
| | EHPE-3150 | 100 | 80 | — | — |
| | jER1004 | — | 20 | — | — |
| | jER1007 | — | — | — | 10 |
| Photopolymerization initiator | SP-172 | 6 | 5 | 6 | 6 |
| Silane coupling agent | A-187 | 3 | 3 | 4 | 4 |
| Additive | Polyethylene glycol 1000 | 10 | — | 15 | — |
| | Polyethylene glycol 2000 | — | — | — | 10 |

TABLE 2

| | | Epoxy resin composition | | | | | |
|---|---|---|---|---|---|---|---|
| | | <B-1> | <B-2> | <B-3> | <B-4> | <B-5> | <B-6> |
| Epoxy resin | jER157S70 | 100 | — | — | 100 | 80 | 80 |
| | EPICLON N-695 | — | 80 | 100 | — | — | — |
| | EPICLON HP-7200 | — | 20 | — | — | — | — |
| | NC-3000 | — | — | — | — | 20 | — |
| | NC-7000 | — | — | — | — | — | 20 |
| Photopolymerization initiator | CPI-410 | 0.5 | 0.5 | 0.5 | 1 | 1 | 1 |
| | SP-172 | 3 | 3 | 3 | 4 | 4 | 4 |
| | TPS-1000 | — | — | — | — | — | — |
| Silane coupling agent | A-187 | 5 | 5 | 5 | 5 | 5 | 5 |

TABLE 3

| | | Epoxy resin composition <C-1> |
|---|---|---|
| Epoxy resin | EPICLON N-695 | 100 |
| Photopolymerization initiator | CPI-410 | 1 |
| | SP-172 | 5 |
| | TPS-1000 | 0.6 |
| Silane coupling agent | A-187 | 5 |

Examples 1 to 6 and Comparative Examples 1 to 4

An inkjet head was produced as a result of the steps of FIG. 2A to FIG. 2G. The water-repellent layer 8 was omitted herein.

Firstly, polymethylisopropenyl ketone (by Tokyo Ohka Kogyo Co., Ltd., product name: ODUR-1010), which is a positive-type photosensitive resin composition, was applied by spin coating, as the resin composition 10, onto the substrate 2 in which there were disposed energy generating elements 1 that generate energy for discharging ink. After application, a film of the applied positive-type photosensitive resin composition was formed through a heating treatment at 120° C. (FIG. 2A).

Next, the resin composition 10 was exposed via the flow channel formation mask (1) 11, using an exposure device UX3000 (product name, by Ushio, Inc.) (FIG. 2B).

Further, the exposed portion was removed using the solvent methyl isobutyl ketone (MIBK), to form the flow channel member (1) 5 and the flow channel pattern 12 (FIG. 2C).

Next, the epoxy resin composition (1) 13 given in Table 2 was applied by spin coating onto the above positive-type photosensitive resin composition, and a film was formed through a thermal treatment at 90° C. (FIG. 2D).

Next, the epoxy resin composition (1) 13 was exposed at 5000 J/m$^2$ using an i-line exposure stepper, via the nozzle formation mask 14 (FIG. 2E).

Next, the exposed portion was cured in a baking (heat) treatment (post-exposure bake) at 90° C., after which the uncured portion of the epoxy resin composition (1) 13 was removed using the solvent PGMEA, to form (FIG. 2F) the nozzles 6 and discharge ports 9 having the shape illustrated in FIG. 3C.

Next, the feeding port 3 was formed by wet etching using an alkaline etching solution. Then the positive-type photosensitive resin composition was irradiated with light using an exposure device UX3000 (product name, by Ushio, Inc.), and developing removal was carried out using the solvent MIBK, to thereby form the liquid flow channel 4 (FIG. 2G). A baking (heating) treatment was further performed at 200° C., to complete an inkjet head.

Separately, a measurement of the film stress of polymethylisopropenyl ketone having been subjected to a baking (heating) treatment at 200° C. yielded a result of 10 MPa.

Table 4 and Table 5 set out the positive-type photosensitive resin compositions, epoxy resin compositions (1) used in the examples and comparative examples, as well as the film thickness, and film stress after curing of a single film.

The method for measuring film stress was as described above, and involved full-surface exposure, at an exposure dose of 5000 J/m$^2$, of the epoxy resin composition (1), with the film thickness of a single film set to 25 μm, followed by a thermal treatment (post-exposure bake) at 90° C., and subsequently by a thermal treatment at 200° C. for 1 hour.

TABLE 4

| | | Example 1 | Example 2 | Example 3 | Example 4 | Example 5 | Example 6 | Example 7 |
|---|---|---|---|---|---|---|---|---|
| Flow channel member (1) | Resin composition | | | | ODUR-1010 | | | |
| | Film thickness $L_1$ (μm) | 16 | 20 | 20 | 16 | 20 | 30 | 20 |
| | Film stress $S_1$ (Mpa) | 11 | 11 | 11 | 11 | 11 | 11 | 11 |
| Flow channel member (2) | Epoxy resin composition (1) | <B-1> | <B-1> | <B-1> | <B-2> | <B-2> | <B-2> | <B-3> |
| | Film thickness $L_2$ (μm) | 40 | 45 | 55 | 30 | 45 | 35 | 45 |
| | Film stress $S_2$ (Mpa) | 25 | 25 | 25 | 30 | 30 | 30 | 27 |
| $L_1 \times S_1 + (L_2 - L_1) \times S_2$ (MPa · μm) | | 776 | 845 | 1095 | 596 | 970 | 480 | 895 |
| $L_2 - L_1$ (μm) | | 24 | 25 | 35 | 14 | 25 | 5 | 25 |
| Evaluation | Peeling | A | A | B | A | B | A | A |
| | Protrusions | A | A | A | A | A | B | A |

TABLE 5

| | | Comparative example 1 | Comparative example 2 | Comparative example 3 | Comparative example 4 |
|---|---|---|---|---|---|
| Flow channel member (1) | Resin composition | | ODUR-1010 | | |
| | Film thickness $L_1$ (μm) | 16 | 20 | 31 | 16 |
| | Film stress $S_1$ (Mpa) | 11 | 11 | 11 | 11 |
| Flow channel member (2) | Epoxy resin composition (1) | <B-1> | <B-2> | <B-2> | <A-1> |
| | Film thickness $L_2$ (μm) | 60 | 70 | 35 | 25 |
| | Film stress $S_2$ (Mpa) | 25 | 30 | 30 | 17 |
| $L_1 \times S_1 + (L_2 - L_1) \times S_2$ (MPa · μm) | | 1276 | 1720 | 461 | 329 |
| $L_2 - L_1$ (μm) | | 44 | 50 | 4 | 9 |
| Evaluation | Peeling | C | C | A | A |
| | Protrusions | A | A | C | C |

Examples 8 to 16 and Comparative Examples 5 to 9

Inkjet heads were produced in accordance with the steps of FIG. 4A to FIG. 4I. The water-repellent layer 8 was omitted herein.

Firstly each epoxy resin composition given in Table 1 was applied by spin coating, as the resin composition 10, onto a respective substrate 2 in which there were disposed energy generating elements 1 that generate energy for discharging ink, and a 25 μm film of the resin composition 10 was then formed through a thermal treatment at 90° C. (FIG. 4A).

Next, the resin composition 10 was exposed at 5000 J/m$^2$ using an i-line exposure stepper, via the flow channel formation mask (1) 11 (FIG. 4B). Further, the unexposed portion was removed using the solvent PGMEA, to form the flow channel member (1) (FIG. 4C).

Next, the epoxy resin composition (2) 16 given in Table 3, and which yielded the flow channel forming member (2-1) through curing, was applied onto the substrate 2 and the flow channel member (1), and was heat-treated at 90° C., to form a 26 μm film (FIG. 4D).

The epoxy resin composition (2) 16 was then exposed at 18000 J/m$^2$ using an i-line exposure stepper, via the flow channel formation mask (2) 17, and was baked (heated) at 50° C., to form the flow channel forming member (2-1) (FIG. 4E).

Next, each epoxy resin composition (1) 13 given in Table 1 or Table 2 was applied onto a respective PET film having a thickness of 100 μm, and was baked (heated) at 70° C., to form a film. Next, each formed film of the epoxy resin composition (1) 13 was transferred in the form of a dry film, by lamination while under pressing and heating at 80° C., onto the epoxy resin composition (2) 16, and the PET film was stripped off using a peeling tape (FIG. 4F).

Next, the epoxy resin composition (1) 13 was exposed at 3000 J/m$^2$ using an i-line exposure stepper, via the nozzle formation mask 14 (FIG. 4G).

Next, the exposed portion was cured in a baking (heating) treatment (post-exposure bake) at 90° C. Thereafter, the uncured portions of the epoxy resin composition (1) 13 and of the epoxy resin composition (2) 16 were removed using the solvent PGMEA, to thereby form the liquid flow channel 4, the nozzles 6 and the discharge ports 9 having the shape illustrated in FIG. 3C (FIG. 4H).

This was followed by formation of the feeding port 3 and by a baking (heating) treatment at 200° C., to thereby complete the inkjet head (FIG. 4I).

Tables 6 and 7 set out the epoxy resin compositions (1) and (2) used in each example, as well as the film thickness and the film stress after curing of a single film.

The method for measuring film stress was as described above; herein the thickness of the single film of the flow channel member (1) was set to 25 μm and the exposure dose of the epoxy resin composition (1) was set to 5000 J/m$^2$. The entire surface of the flow channel member (2) was exposed, with the film thickness of the flow channel forming member (2-1) set to 25 μm, the exposure dose of the epoxy resin composition (2) set to 18000 J/m$^2$, the film thickness of flow channel member (2-2) set to 25 μm, and the exposure dose of the epoxy resin composition (1) set to 3000 J/m$^2$. This was followed by a thermal treatment (post-exposure bake) at 90° C., with a subsequent thermal treatment at 200° C. for 1 hour.

TABLE 6

| | | Example 8 | Example 9 | Example 10 | Example 11 | Example 12 | Example 13 | Example 14 | Example 15 | Example 16 |
|---|---|---|---|---|---|---|---|---|---|---|
| Flow channel member (1) | Resin composition | <A-1> | <A-2> | <A-3> | <A4> | <A1> | <A-1> | <A-4> | <A-4> | <A-1> |
| | Film thickness $L_1$ (μm) | 25 | 25 | 25 | 25 | 25 | 25 | 25 | 25 | 25 |
| | Film stress $S_1$ (Mpa) | 17 | 20 | 19 | 20 | 17 | 17 | 20 | 20 | 17 |
| Flow channel member (2) | Epoxy resin composition (1) | <B-4> | <B-4> | <B-4> | <B-4> | <B-5> | <B-6> | <B-4> | <B-5> | <B-4> |
| | Epoxy resin composition (2) | <C-1> 26 μm | <C-1> 26 μm | <C-1> 26 μm | <C-1> 26 μm | <C-1> 26 μm | <C-1> 26 μm | <C-1> 26 μm | <C-1> 26 μm | <C-1> 26 μm |
| | Film thickness $L_2$ (pm) | 40 | 40 | 40 | 40 | 40 | 40 | 29 | 40 | 50 |
| | Film stress $S_2$ (Mpa) | 25 | 25 | 25 | 25 | 29 | 28 | 25 | 29 | 25 |
| $L_1 \times S_1 + (L_2 - L_1) \times S_2$ (MPa · μm) | | 800 | 875 | 850 | 875 | 860 | 845 | 600 | 935 | 1050 |
| $L_2 - L_1$ (μm) | | 15 | 15 | 15 | 15 | 15 | 15 | 4 | 15 | 25 |
| Evaluation | Peeling | A | A | A | A | A | A | A | B | B |
| | Protrusions | A | A | A | A | A | A | B | A | A |

TABLE 7

| | | Comparative example 5 | Comparative example 6 | Comparative example 7 | Comparative example 8 | Comparative example 9 |
|---|---|---|---|---|---|---|
| Flow channel member (1) | Resin composition | <A-1> | <A-1> | <B-1> | <B-2> | <A-1> |
| | Film thickness $L_1$ (μm) | 25 | 25 | 25 | 25 | 25 |
| | Film stress $S_1$ (Mpa) | 17 | 17 | 25 | 30 | 17 |
| Flow channel member (2) | Epoxy resin composition (1) | <B-4> | <B-6> | <B-4> | <B-4> | <A-1> |
| | Epoxy resin composition (2) | <C-1> 26 μm | <C-1> 26 μm | <C-1> 26 μm | <C-1> 26 μm | <C-1> 26 μm |
| | Film thickness $L_2$ (μm) | 60 | 60 | 50 | 50 | 50 |
| | Film stress $S_2$ (Mpa) | 25 | 28 | 25 | 25 | 17 |
| $L_1 \times S_1 + (L_2 - L_1) \times S_2$ (MPa · μm) | | 1300 | 1405 | 1250 | 1375 | 850 |
| $L_2 - L_1$ (μm) | | 35 | 35 | 25 | 25 | 25 |
| Evaluation | Peeling | C | C | C | C | A |
| | Protrusions | A | A | A | A | C |

Peeling Evaluation

Each produced liquid discharge head was filled with a 30% aqueous solution of 2-pyrrolidone, was stored in an environment at 121° C. and 2 atm for 20 hours (PCT test), and was thereafter stored in an environment at 60° C. for 2 hours. This was performed up to a total of 10 cycles, after which the liquid discharge head was observed at 20× magnifications using an optical microscope (by Nikon Corporation), and peeling of the flow channel member (2) off the substrate was checked and evaluated according to the following criteria.

Evaluation Criteria

A: no observable peeling of the flow channel member (2) off the substrate.

B: the flow channel member (2) observably peels slightly off the substrate, but without affecting printing.

C: significant peeling of the flow channel member (2) off the substrate.

Evaluation of Protrusion Deformation

Deformation of the protrusions 15 of the discharge ports, arising from permeation of the above aqueous solution, was captured using a surface profile measurement system (by Hitachi High-Tech Science Corporation), and occurrence or absence of deformation leading to impaired print quality was checked and evaluated according to the criteria below.

Evaluation Criteria

A: no significant deformation observed in the protrusions.

B: protrusions slightly sunk toward the energy generating elements, but without affecting printing.

C: protrusions significantly sunk toward the energy generating elements.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-008035, filed Jan. 22, 2020 which is hereby incorporated by reference herein in its entirety.

What is claimed is:

1. A liquid discharge head, comprising:

a substrate comprising a liquid feeding port and an energy generating element for liquid discharge; and a flow channel member comprising, on the substrate, a discharge port through which a liquid is discharged, and a liquid flow channel that communicates with both the liquid feeding port and the discharge port, wherein:

the flow channel member comprises a flow channel member (1) not comprising a surface in contact with the liquid and a flow channel member (2) comprising a surface in contact with the liquid, a film stress $S_1$ of the flow channel member (1) and a film stress $S_2$ of the flow channel member (2) are in a relationship $S_1<S_2$, a film thickness $L_1$ of the flow channel member (1) and a film thickness $L_2$ of the flow channel member (2), in a direction perpendicular to the substrate, are in a relationship $L_1<L_2$, and the film stress $S_1$ and $S_2$ and the film thickness $L_1$ and $L_2$ satisfy a relationship of expression (I):

$$470\ \text{MPa}\cdot\mu\text{m}<[L_1\times S_1+(L_2-L_1)\times S_2]<1200\ \text{MPa}\cdot\mu\text{m} \quad \text{(I)}.$$

2. The liquid discharge head according to claim 1, wherein the film stress $S_1$ and $S_2$ and the film thickness $L_1$ and $L_2$ satisfy a relationship of expression (I'):

$$650\ \text{MPa}\cdot\mu\text{m}<[L_1\times S_1+(L_2-L_1)\times S_2]<900\ \text{MPa}\cdot\mu\text{m} \quad \text{(I')}.$$

3. The liquid discharge head according to claim 1, wherein the flow channel member (1) makes up at least a part of a side wall of the liquid flow channel, and the flow channel member (2) covers, so as to preclude contact with the liquid, a side wall of the flow channel member (1) that makes up the at least a part of the side wall of the liquid flow channel.

4. The liquid discharge head according to claim 1, wherein the film stress $S_1$ of the flow channel member (1) is not more than 20 MPa.

5. The liquid discharge head according to claim 1, wherein the film stress $S_2$ of the flow channel member (2) is at least 20 MPa.

6. The liquid discharge head according to claim 1, wherein the flow channel member (1) comprises a photodegradable positive-type photosensitive resin composition.

7. The liquid discharge head according to claim 6, wherein the photodegradable positive-type photosensitive resin composition comprises polymethyl methacrylate and a copolymer of methyl methacrylate and a vinyl monomer having a ketone moiety; a mixture of polymethyl methacrylate and polystyrene, polyvinyl acetate or polycarbonate; a copolymer of methyl methacrylate and an acrylic acid ester; polymethylisopropenyl ketone; or polyphenylvinyl ketone.

8. The liquid discharge head according to claim 1, wherein the flow channel member (2) comprises a cured product of a negative-type photosensitive resin composition that comprises a photopolymerization initiator and a cationic polymerization-type multifunctional epoxy resin having an at least tri-functional epoxy group.

9. The liquid discharge head according to claim 8, wherein the cationic polymerization-type multifunctional epoxy resin contains at least one multifunctional epoxy resin selected from the group consisting of a phenol novolac type, a cresol novolac type and a bisphenol A novolac type.

10. The liquid discharge head according to claim 8, wherein the cationic polymerization-type multifunctional epoxy resin has at least one skeleton selected from the group consisting of a dicyclopentadiene skeleton, a biphenyl skeleton and a naphthalene skeleton.

11. The liquid discharge head according to claim 1, wherein the film thickness $L_1$ and the film thickness $L_2$ satisfy a relationship $L_2-L_1>4$ μm.

12. The liquid discharge head according to claim 1, wherein the film thickness $L_2$ is at least 30 μm.

13. The liquid discharge head according to claim 1, wherein the flow channel member (2) is a flow channel member comprising a flow channel forming member (2-1) provided on the substrate and forming a side wall of the liquid flow channel, and a flow channel member (2-2) provided on the flow channel forming member (2-1) and comprising the discharge port through which the liquid is discharged, and the flow channel forming member (2-1) and the flow channel member (2-2) are formed of cured products of different negative-type photosensitive resin compositions.

14. A method for producing a liquid discharge head that comprises a substrate comprising a liquid feeding port and an energy generating element for liquid discharge, and a flow channel member comprising, on the substrate, a discharge port through which a liquid is discharged and a liquid flow channel that communicates with both the liquid feeding port and the discharge port, with the flow channel member comprising a flow channel member (1) not comprising a surface in contact with the liquid and a flow channel member (2) comprising a surface in contact with the liquid, the method comprising:

forming, on the substrate, the flow channel member (1) that constitutes a part of a side wall of the liquid flow channel, by patterning of a first photosensitive resin composition; and patterning a second photosensitive resin composition so as to cover the flow channel member (1), to form the flow channel member (2) that comprises the discharge port through which the liquid is discharged, and the liquid flow channel that communicates with both the liquid feeding port and the discharge port, wherein:

a film stress $S_1$ of the flow channel member (1) and a film stress $S_2$ of the flow channel member (2) are in a relationship $S_1<S_2$, a film thickness $L_1$ of the flow channel member (1) and a film thickness $L_2$ of the flow channel member (2), in a direction perpendicular to the substrate, are in a relationship $L_1<L_2$, and the film stress $S_1$ and $S_2$ and the film thickness $L_1$ and $L_2$ satisfy a relationship of expression (I):

$$470\ \text{MPa}\cdot\mu\text{m}<[L_1\times S_1+(L_2-L_1)\times S_2]<1200\ \text{MPa}\cdot\mu\text{m} \quad \text{(I)}.$$

15. The method according to claim 14, wherein the film stress $S_1$ and $S_2$ and the film thickness $L_1$ and $L_2$ satisfy a relationship of expression (I'):

$$650\ \text{MPa}\cdot\mu\text{m}<[L_1\times S_1+(L_2-L_1)\times S_2]<900\ \text{MPa}\cdot\mu\text{m} \quad \text{(I')}.$$

16. The method according to claim 14, wherein the film stress $S_1$ of the flow channel member (1) is not more than 20 MPa.

17. The method according to claim 14, wherein the film stress $S_2$ of the flow channel member (2) is at least 20 MPa.

18. The method according to claim 14, wherein the flow channel member (1) comprises a photodegradable positive-type photosensitive resin composition.

19. The method according to claim 18, wherein the photodegradable positive-type photosensitive resin composition comprises polymethyl methacrylate and a copolymer of methyl methacrylate and a vinyl monomer having a ketone moiety; a mixture of polymethyl methacrylate and polystyrene, polyvinyl acetate or polycarbonate; a copolymer of methyl methacrylate and an acrylic acid ester; polymethylisopropenyl ketone; or polyphenylvinyl ketone.

20. The method according to claim 14, wherein the flow channel member (2) comprises a cured product of a negative-type photosensitive resin composition that comprises a photopolymerization initiator and a cationic polymerization-type multifunctional epoxy resin having an at least trifunctional epoxy group.

* * * * *